United States Patent [19]

Severin et al.

[11] Patent Number: 4,630,734

[45] Date of Patent: Dec. 23, 1986

[54] PACKAGE FOR HANGING OR STAND-UP DISPLAY

[75] Inventors: Eric Severin; Arne Jansson; Kjell Östman, all of Jönköping, Sweden

[73] Assignee: AB Jönköping Vulcan, Sweden

[21] Appl. No.: 714,252

[22] Filed: Mar. 21, 1985

[30] Foreign Application Priority Data

Mar. 30, 1984 [SE] Sweden ..... 84017748

[51] Int. Cl.[4] ..... B65D 6/06

[52] U.S. Cl. ..... 206/461; 206/102; 206/129; 206/468; 206/806

[58] Field of Search ..... 206/102, 127, 129, 468, 206/461, 806, 1.5; 229/20, 11, 9

[56] References Cited

U.S. PATENT DOCUMENTS

| | | | |
|---|---|---|---|
| 370,481 | 9/1887 | Jezalik | 229/11 |
| 472,022 | 4/1892 | Bachert | 206/127 |
| 965,012 | 7/1910 | Radford | 206/127 |
| 1,289,978 | 12/1918 | Ward | 206/127 |
| 1,331,231 | 2/1920 | Ambrose | 206/102 |
| 1,362,820 | 12/1920 | Rinker | 220/345 |
| 3,082,902 | 3/1963 | Kimbrough, Jr. | 206/806 |
| 3,603,456 | 9/1971 | Bisschop | 206/527 |
| 4,007,828 | 2/1977 | Mayled | 229/9 |
| 4,437,566 | 3/1984 | Szahler | 229/20 |
| 4,485,920 | 12/1984 | Skylrik | 229/11 |

FOREIGN PATENT DOCUMENTS

| | | | |
|---|---|---|---|
| 446174 | 3/1968 | Switzerland | 229/20 |
| 4004 | of 1894 | United Kingdom | 206/127 |
| 5717 | of 1894 | United Kingdom | 206/127 |
| 1954 | of 1899 | United Kingdom | 206/102 |
| 23710 | of 1910 | United Kingdom | 206/127 |
| 110271 | 10/1917 | United Kingdom | 229/127 |

*Primary Examiner*—William Price
*Assistant Examiner*—Brenda J. Ehrhardt
*Attorney, Agent, or Firm*—Lerner, David, Littenberg, Krumholz & Mentlik

[57] ABSTRACT

A package comprising an inner box and an outer box and provided with a hanger device for placing the package as an integral unit onto a horizontal support.

The hanger device is formed by an extending end of a plate-shaped element arranged for insertion between the inner box and the outer box. The plate-shaped element is dimensioned for covering the major part of the broad side of the package.

There are fixation means formed by said plate-shaped element for removably mounting said boxes to said plate-shaped element.

12 Claims, 17 Drawing Figures

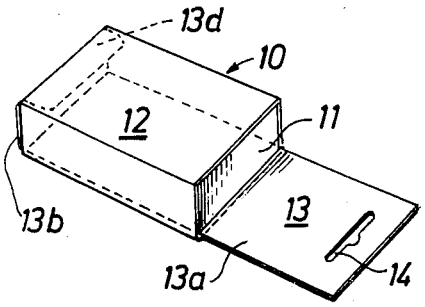
Fig.1
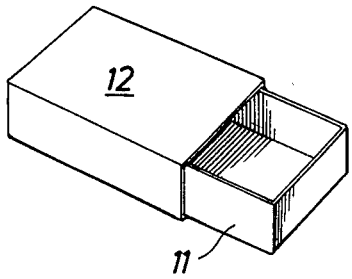
Fig.2
Fig.3
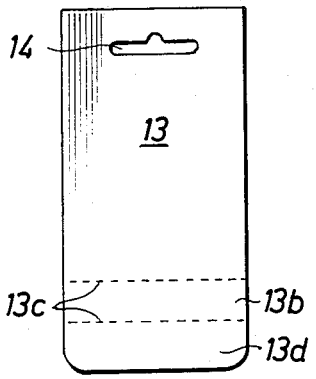
Fig.4
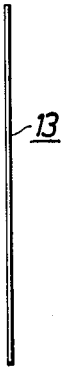
Fig.5
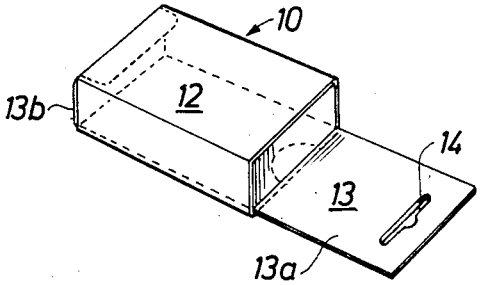
Fig.6
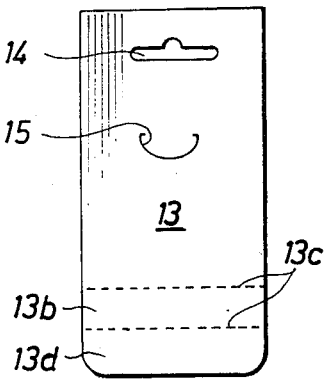

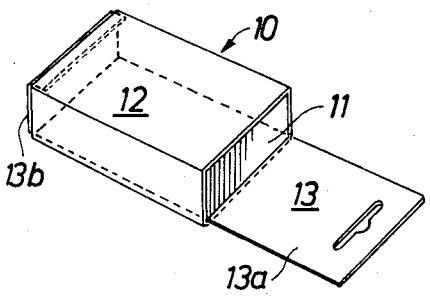
Fig.7
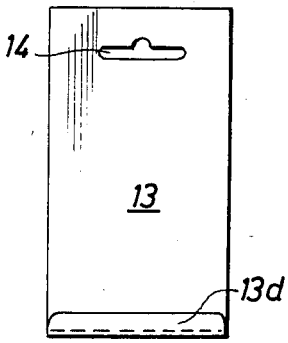
Fig.8
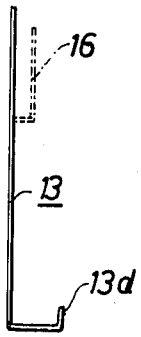
Fig.9
Fig.10
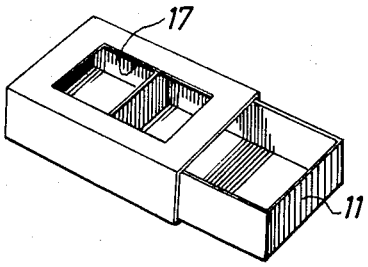
Fig.11
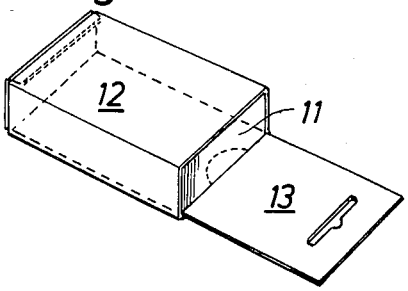
Fig.12
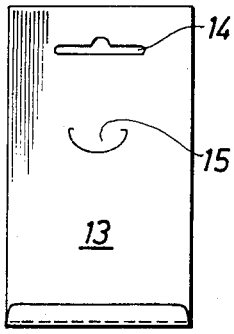
Fig.13
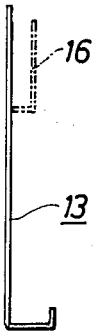
Fig.14
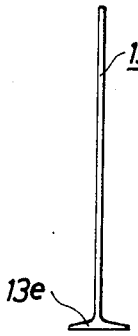

PACKAGE FOR HANGING OR STAND-UP DISPLAY

FIELD OF THE INVENTION

The present invention relates to a package comprising an inner box and an outer box and provided with a hanger device for placing the package as an integral unit in for instance a display-stand and more precisely onto a horizontal support of such a stand.

BACKGROUND OF THE INVENTION

The basic problem of the invention is to broaden the field of use for a type of package well known for many years and comprising an inner box and an outer box, basically of the type used today within the match industry. Such packages are manufactured in extremely large series and the level of costs is extremely advantageous.

Prior attempts to make use of this fact in other fields than match business, however, have not been successful.

The invention is based on the insight that there should not be made any substantial changes of the basic structure of a package of the actual type comprising an outer box (skillet) and an inner box. The hanger device which should be provided should be realized in another way than by modifying the outer box.

SUMMARY OF THE INVENTION

According to the invention it is suggested a package, comprising an inner box and an outer box, a plate-shaped element insertable between the inner box and the outer box for covering at least the major part of the broad side of the package, a hanger device formed by an extending end of said plate-shaped element for placing the package as an integral unit onto a horizontal support, and fixation means formed by said plate-shaped element for removably mounting said boxes to said plate-shaped element.

Preferably, the plate-shaped element comprises a thermoformable plastics material, and said fixation means comprises a thermoformed shoulder for releasable locking abutment against the edge of an opening in the outer box.

In one embodiment said opening is formed in a broad side of the outer box and occupies a major part of said broad side.

Preferably, said opening also comprises a cut-out region at an edge of the outer box.

In a most preferred embodiment the plate-shaped element is formed from a transparent plastics material, and arranged for insertion between a side of the outer box having an opening and the open side of a tray-shaped inner box.

The plate-shaped element preferably also comprises an end portion at the end of the plate-shaped element opposite to the hanger end, the end portion extending generally perpendicular to the plane of the plate-shaped element a distance less than the distance between the broad sides of the package.

For facilitating handling the first-mentioned distance is less than half of the second distance In another preferred embodiment the shoulder is formed as a section of a plate-shaped element of cardboard or similar which is foldable at least around the inner box.

In order to further improve the attachment of the package on the insert element there may be a tongue-shaped punched-out element at that region of the package where the plate-shaped element is inserted.

In an alternative embodiment the shoulder is formed in a plate-shaped element of a permanently deformable material, for instance plastics.

The combination of an outer box having an opening, a conventional inner box and a transparent insert element, means an extremely competitive alternative to folding boxes having "windows". The term "folding boxes having windows" means cardboard folding boxes having a transparent film over a punched-out region, usually in the broad side. This requires specific equipment for the sealing of the film and means a considerable cost increase.

By means of a plate-shaped element according to the invention it is surprisingly simple to accomplish an arrangement allowing ocular access to the interior of the package as well as a hanger arrangement for the package and facilities for reclosing, all this without comprehensive modification of the basic structure Of the package or the machinery for manufacturing and filling.

A further embodiment of the plate-shaped element comprises a plate-shaped element of a thermoformable material, where said means for fixation of the inner box comprises an end portion of the plate-shaped element which is deformable by heat supply.

BRIEF DESCRIPTION OF THE DRAWINGS

FIG. 1 in a perspective view shows a first embodiment of a package according to the invention, FIG. 2 in a perspective view shows the inner box and the outer box of the package, FIG. 3 shows a planar insert element punched-out from cardboard, FIG. 4 shows the element in FIG. 1 from the side, FIG. 5 in a perspective view shows a second embodiment of a package according to the invention, FIG. 6 shows the planar insert element in a side view, FIG. 7 in a perspective view shows a third embodiment of a package according to the invention, FIG. 8 in a front view shows the insert element, FIG. 9 in a side view shows the insert element, FIG. 10 in a perspective view shows the inner box and the outer box, FIG. 11 in a perspective view shows a fourth embodiment of the package according to the invention, FIG. 12 in a front view shows the insert element, FIG. 13 in a side view shows the insert element, FIG. 14 in a side view shows an insert element having a deformed end.

DESCRIPTION OF PREFERRED EMBODIMENTS

Figure 15:
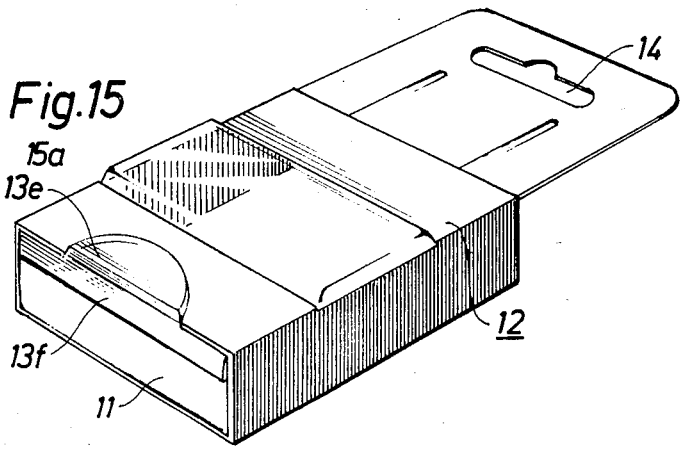
FIG. 15 in a perspective view shows the package and a transparent insert element having shoulders formed therein, FIG. 16 in a perspective view shows the inner and outer boxes of the package in FIG. 15, and FIG. 17 in a perspective view shows the insert element of the package in FIG. 15.

The package 10 in FIG. 1 comprises an inner box 11, an outer box 12 and an insert element 13. In this embodiment all elements are manufactured from cardboard. The insert element has a length/width relation such that the broad side of the inner box will be covered almost fully and such that sections **13*a* and 13*b* are obtained. When the insert element is inserted between the inner box and the outer box, the section 13***a* forms the actual hanger element and the section 13*b* is a "shoulder forming element". Creasing lines 13*c* make it possible to fold up the section 13*b* onto the outside of the short side of the inner box and insert a tongue 13*d* below the upper broad side of the outer box. An opening 14 in the section 13*a* acts as a hanger opening.

In FIGS. 5 and 6 the arrangement basically is the same, the difference being that the insert element has a punched-out tongue 15 which forms an auxiliary means for the fixation of the outer box onto the plate-shaped element.

In FIGS. 7 to 10 the insert element 13 is a permanently deformed element, for instance of a thermoplastics material, where the section 13*b* is permanently folded over. The material of the insert element is transparent allowing an ocular inspection of the contents of a package, provided the broad side of the outer box has an opening 17 and the inner box has the orientation shown.

The broken lines 16 indicate how the hanger section 13*a* may be deflected for better balancing the gravitation centre.

The arrangement in FIGS. 11 to 13 basically is identical to the one just described, the difference being that the insert element is provided with a punched-out tongue 15.

In FIG. 14 the insert element for instance comprises a plastics material, preferably a thermoplastics material, and has an enlarged end portion 13*e*. This enlarged portion can be formed by heat deformation/jolting of the end of the disc 13.

Figure 16:
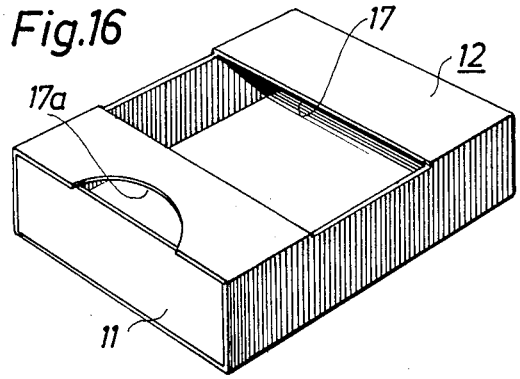
Figure 17:
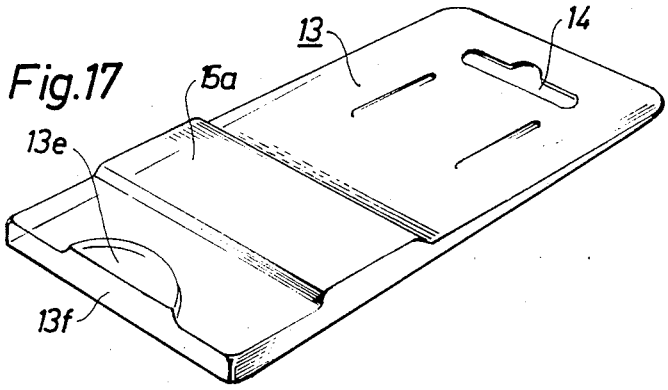

In FIGS. 15 to 17 there is shown a package having an outer box 12 and an inner box 11 and an insert element 13 of a transparent and theremoplastics material, for instance polypropylene. The outer box has a central opening 17 and a punched-out edge opening 17*a*. There are thermoformed shoulders 15*a* and 13*e* in the element 13 of such a size and at such a distance that edges defining the shoulders abut against the edges of the openings 17 and 17*a* when the plate-shaped element 13 is inserted between the boxes for removably mounting the boxes to the plate-shaped element.

At the end of the element 13 remote from the hanger 14 there is a short end piece 13*f* extending in a direction generally perpendicular to the plane of the element 13 a distance less than half the distance between the broad sides of the outer box.

The plastics material of the element 13 is flexible, implying that the end piece will be flexed away as soon as the inner box is pushed open from the "open end" of the package.

Alternatively, the inner box may be pushed out by placing the finger below the end piece 13*f* and pushing the inner box towards the hanger end.

The material of the insert element is flexible and allows insertion of the element by temporarily deforming the shoulders if necessary. It is also possible to place the insert in the correct position inside the outer box before the inner box is inserted.

Although a limited number of embodiments have been described it is realized that the inventive idea covers further modifications and alternatives, from a constructive point of view as well as material. Instead of cardboard material it is for instance also possible to use plastics for the inner box and the outer box, and also wood of the type used for old time boxes.

We claim:

1. A package comprising an inner box having a predetermined length, an outer box including an entrance aperture, an exit aperture, and a pathway of at least said predetermined length extending therebetween, whereby said inner box can move slidably along said pathway between an open position in which said inner box is only partially contained within said pathway and a closed position in which said inner box is contained entirely within said pathway, and insert means insertable into said pathway, said insert means having a length greater than said predetermined length whereby when said insert means is inserted within said pathway between said inner and outer boxes said insert means can extend for substantially said entire predetermined length and an extended portion of said insert means extends beyond said outer box, whereby said package may be mounted on a support affixed to said extended portion of said insert means, said insert means further including fixation means for removably maintaining a relatively fixed relationship between said outer box and said insert means when said insert means is inserted within said pathway while simultaneously permitting said inner box to be freely slidable along said pathway from said closed position to said open position.

2. The package of claim 1 wherein said insert means comprises a thermoformable plastic material.

3. The package of claims 1 or 2 wherein said pathway is defined by a pair of longitudinally extending sides of said outer box, and wherein said fixation means comprises abutment means for at least partially closing said pathway adjacent to said exit aperture by extending substantially perpendicularly to said insert means between said pair of longitudinally extending sides of said outer box when said insert means is inserted within said pathway so as to prevent said inner box from exiting from said exit aperture.

4. The package of claim 2 wherein said outer box includes a longitudinal opening along said pathway, and wherein said fixation means comprises a thermoformed shoulder formed on said insert means and configured to releasably abut against said longitudinal opening in said outer box.

5. The package of claim 4 wherein said longitudinal opening in said outer box comprises a first opening, wherein said outer box includes a second opening located at an edge of said outer box adjacent to said exit aperture, wherein said thermoformed shoulder comprises a first thermoformed shoulder, and wherein said fixation means includes a second thermoformed shoulder configured to releasably abut against said second opening in said outer box.

6. The package of claim 4 wherein said insert means is transparent, and wherein said inner box includes and open longitudinal side whereby when said inner box is in said closed position said open longitudinal side of said inner box is juxtaposed with said longitudinal opening in said outer box and the inside of said inner box is thereby viewable therethrough.

7. The package of claim 3 wherein said abutment means extends substantially perpendicularly to said insert means a distance comprising less than about half the distance between said pair of longitudinally extending sides of said outer box.

8. The package of claim 3 wherein said abutment means comprises a foldable portion of said insert means located at the end of said insert means whereby upon folding said foldable portion said abutment means extends substantially perpendicualrly to said insert means the entire distance between said pair of longitudinally extending sides of said outer box.

9. The package of claim 3 wherein said insert means includes flap means bendable out of the plane of said insert means, said flap means being located adjacent to said entrance aperture when said insert means is inserted within said pathways whereby when said flap means is bent out of the plane of said insert means it is capable of assisting in maintaining said relatively fixed relationship between said outer box and said insert means.

10. The package of claim 9 wherein said flap means comprises an arcuate shaped, punched-out element in said insert means.

11. The package of claim 2 wherein said pathway is defined a pair of longitudinally extending sides of said outer box, wherein said fixation means comprises abutment means for at least partially closing said pathway adjacent to said exit aperture by extending substantially perpendicularly to said insert means between said pair of longitudinally extending sides of said outer box when said insert means is inserted within said pathway so as to prevent said inner box from exiting from said exit aperture, and wherein said abutment means comprises a permanently deformed portion of said insert means.

12. The package of claim 11 wherein said permanently deformed portion of said insert means comprises a heat deformed portion of said thermoformable plastic material comprising said insert means.

* * * * *